US005897109A

United States Patent [19]

Lin

[11] Patent Number: 5,897,109

[45] Date of Patent: Apr. 27, 1999

[54] QUICKLY ADJUSTABLE VISE

[76] Inventor: Kuo-Chuan Lin, No. 26-4, Hou Chuang Road, Pei Tun Chu, Taichung, Taiwan

[21] Appl. No.: 08/898,913

[22] Filed: Jul. 23, 1997

[51] Int. Cl.[6] ..... B25B 1/02

[52] U.S. Cl. ..... 269/182

[58] Field of Search ..... 269/181, 182, 269/173, 174

[56] References Cited

U.S. PATENT DOCUMENTS

| | | | |
|---|---|---|---|
| 1,721,227 | 7/1929 | Manley | 269/182 |
| 2,602,369 | 7/1952 | Yinger | 269/182 |
| 2,671,482 | 3/1954 | Gordon | 269/182 |
| 3,220,721 | 11/1965 | Wahli et al. | 269/182 |
| 3,492,886 | 2/1970 | Naureckas | 269/182 |

*Primary Examiner*—Robert C. Watson

*Attorney, Agent, or Firm*—Charles E. Baxley

[57] ABSTRACT

A vise includes a fixed body mounted to a working table. The fixed body includes a compartment defined therein, a longitudinal bore extending therethrough and partially communicating with the compartment, and a transverse bore defined in two lateral sides thereof and communicating with the compartment. A shaft is pivotally mounted in the longitudinal bore and includes a reduced eccentric section. A positioning block is mounted in the compartment of the fixed body and includes a hole in alignment with the transverse bore. An adjusting screw rod is extended through the transverse bore of the fixed body and the hole of the positioning block. The adjusting screw rod includes a first end to which an operative handle is attached and a second end to which a movable jaw is fixedly attached. A pivoting member is provided for pivoting the shaft between a first position in which the adjusting screw rod disengages from the positioning block and a second position in which the adjusting screw rod engages with the positioning block.

5 Claims, 4 Drawing Sheets

QUICKLY ADJUSTABLE VISE

BACKGROUND OF THE INVENTION

1. Field of the Invention

The present invention relates to an improved vise which may be quickly moved to securely clamp the work piece to be processed.

2. Description of the Related Art

A typical vise generally includes a fixed jaw, a movable jaw attached to an end of a screw rod, and a handle attached to the other end of the screw rod. Rotational movement of the handle causes longitudinal movements of the screw rod and the movable jaw so as to release or clamp a workpiece between the jaws. Nevertheless, it is time-consuming to move of the movable jaw to clamp the workpiece as the movable jaw is merely moved by a pitch of the screw rod upon each rotation of the handle. The present invention is intended to provide an improved vise which mitigates and/or obviates the above problems.

SUMMARY OF THE INVENTION

A vise in accordance with the present invention comprises a fixed body mounted to a working table. The fixed body includes a compartment defined therein, a longitudinal bore extending therethrough and partially communicating with the compartment, and a transverse bore defined in two lateral sides thereof and communicating with the compartment.

A shaft is pivotally mounted in the longitudinal bore. The shaft includes a notch defined in a mediate portion thereof to form a reduced eccentric section. A positioning block is mounted in the compartment of the fixed body and includes a hole in alignment with the transverse bore. A portion of a periphery which defines the hole has a threading defined therein. An adjusting screw rod is extended through the transverse bore of the fixed body and the hole of the positioning block. The adjusting screw rod includes a first end to which an operative handle is attached and a second end to which a movable jaw is fixedly attached.

A biasing means is provided for biasing the positioning block toward the transverse bore for releasably engaging with the reduced eccentric section of the shaft. A pivoting means is provided for pivoting the shaft between a first position in which the shaft engages with the positioning block such that the adjusting screw rod disengages from the threading of the positioning block and a second position in which the shaft disengages from the positioning block such that the adjusting screw rod engages with the threading of the positioning block.

The fixed body includes a screw hole defined in an upper side thereof and communicated with the longitudinal bore, and the shaft includes an annular groove defined in a periphery thereof. A screw is extended through the screw hole and into the annular groove to prevent undesired longitudinal movement of the shaft. Preferably, the shaft has an end extending beyond the fixed body, and the pivoting means includes a handle attached to the end of the shaft.

In an embodiment of the invention, the positioning block includes a protrusion formed on an upper side thereof and extendible into the longitudinal bore.

The positioning block may include a recess defined in an underside thereof, and the biasing means includes a spring having an upper end received in the recess and a lower end securely attached to the working table.

Other objects, advantages, and novel features of the invention will become more apparent from the following detailed description when taken in conjunction with the accompanying drawings.

DESCRIPTION OF THE PREFERRED EMBODIMENT

Figure 1:
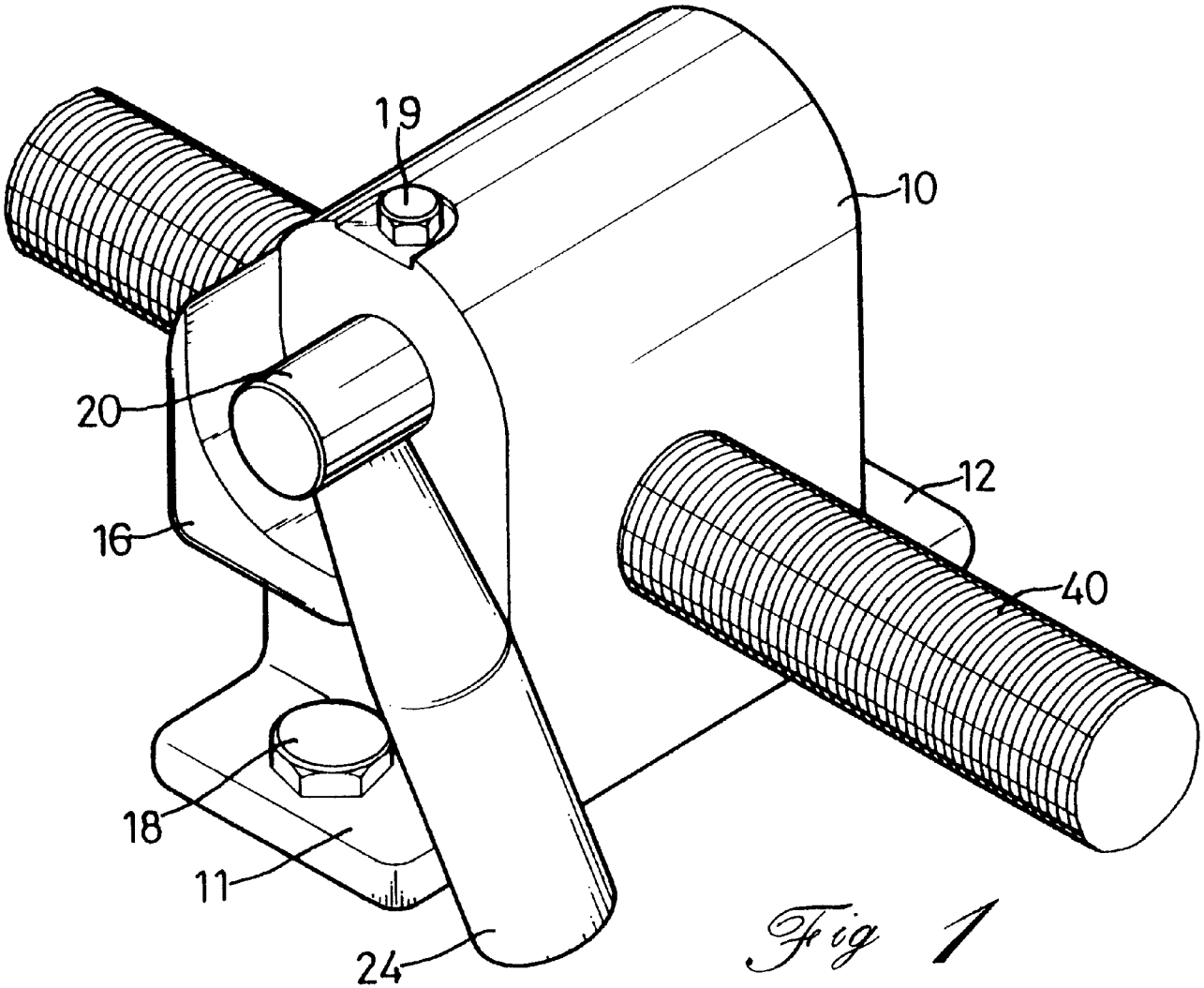
FIG. 1 is a perspective view of a vise in accordance with the present invention.
Figure 2:
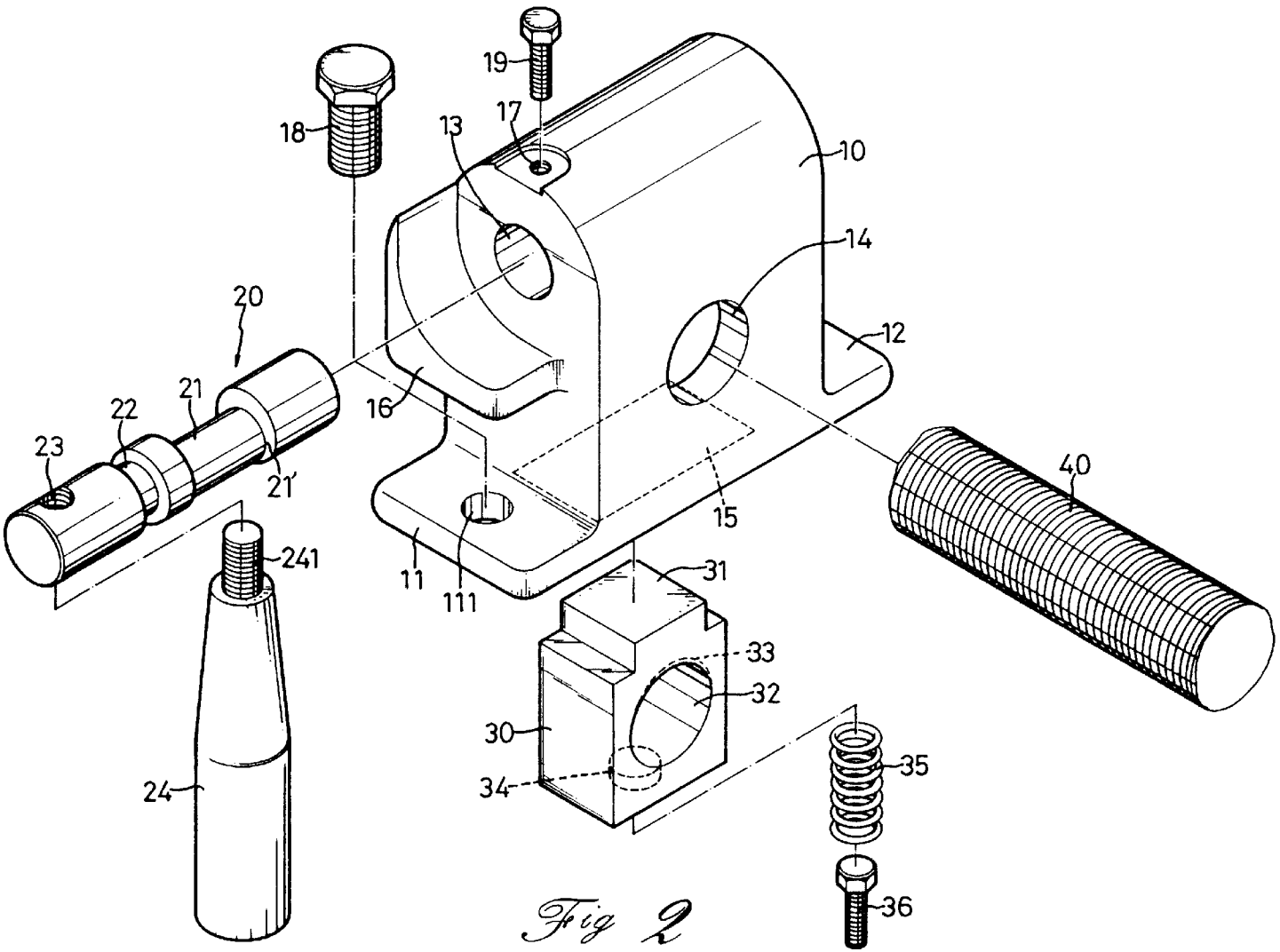
FIG. 2 is an exploded view of the vise in accordance with the present invention.

Referring to FIGS. 1 and 2, a vise in accordance with the present invention generally comprises a fixed body 10 which can be mounted to a working table 50 (FIG. 3) by bolts 18 extending through holes 111 defined in each of two sides 11 and 12 thereof. The fixed body 10 includes a compartment 15 (FIG. 3) defined therein, a longitudinal bore 13 extending therethrough and partially communicating with the compartment 15, and a transverse bore 14 defined in two lateral sides thereof and communicating with the compartment 15. A substantially L-shaped seat 16 is formed on a side of the fixed body 10, and a screw hole 17 is defined in an upper side of the fixed body 10 and communicates with the longitudinal bore 13, as shown in FIG. 2.

Figure 3:
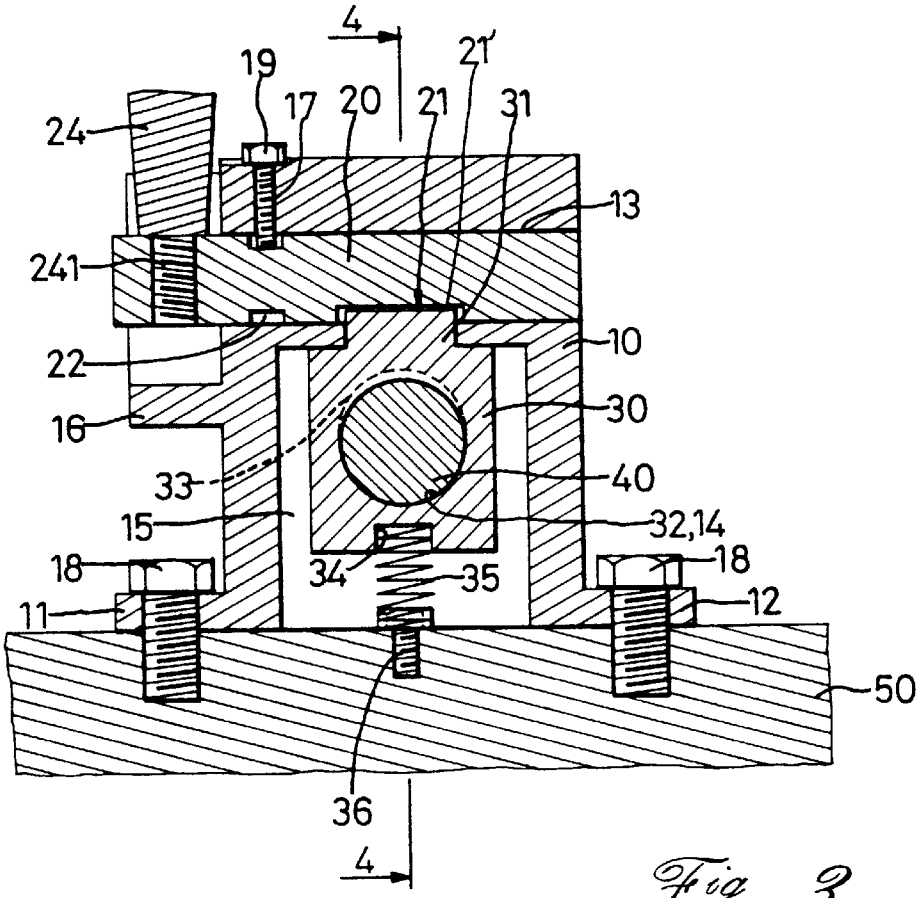
FIG. 3 is a cross sectional view of the vise in accordance with the present invention, the upper end of the vise is omitted for clarity.

Still referring to FIGS. 1 and 2, and further to FIG. 3, a shaft 20 is pivotally mounted in the longitudinal bore 13 and having an end extending beyond the fixed body 10. The end of the shaft 20 includes a threaded hole 23 for engaging with a threaded stud 241 of a handle 24. The shaft 20 further includes a notch 21' defined in a mediate portion thereof to form a reduced eccentric section 21, and an annular groove 22 is defined in a periphery of the shaft 20. A screw 19 is extended through the screw hole 17 and into the annular groove 22 to prevent undesired longitudinal movement of the shaft 20.

A positioning block 30 is mounted in the compartment 15 of the fixed body 10 and includes a hole 32 in alignment with the transverse bore 14. A portion of the periphery defining the hole 32 (preferably an upper portion, see FIGS. 2 and 3) has a threading defined therein, which will be described later. The positioning block 30 includes a protrusion 31 formed on an upper side thereof and extendible into the longitudinal bore 13. Defined in an underside of the positioning block 30 is a recess 34 for receiving an end of an elastic means, e.g., a spring 35 the other end of which is attached to a bolt 36 mounted to the working table 50 for biasing the positioning block 30 upwardly toward the longitudinal bore 13.

Figure 4:
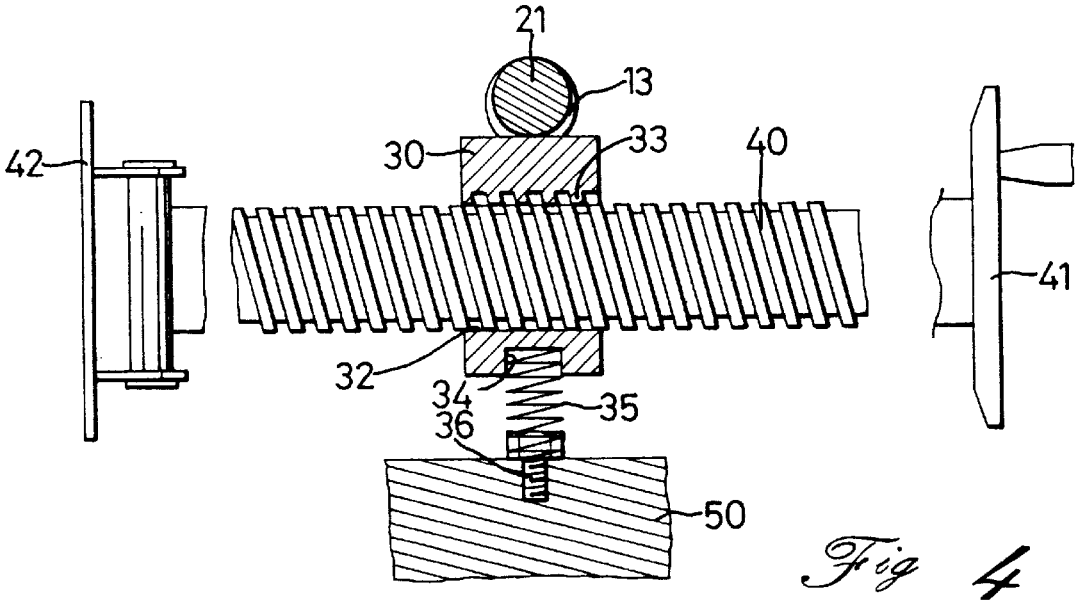
FIG. 4 is a cross sectional view taken along line 4—4 in FIG. 3.

Referring to FIGS. 3 and 4, an adjusting screw rod 40 is extended through the transverse bore 14 and the hole 32 and includes a first end to which an operative handle or handle wheel 41 is attached and a second end to which a movable jaw 42 is fixedly attached.

In use, referring to FIGS. 3 and 4, when the handle 24 is in a first position in which the notch 21' faces the compartment 15 and thus receives the protrusion 31 of the block 30

(under the action of the spring 35), the screw rod 40 does not engage with the threading in the hole 32 such that the screw rod 40 may be quickly moved along a longitudinal direction of the screw rod 40. Thus, the movable jaw 42 may approach the fixed jaw (not shown) quickly.

Figure 5:
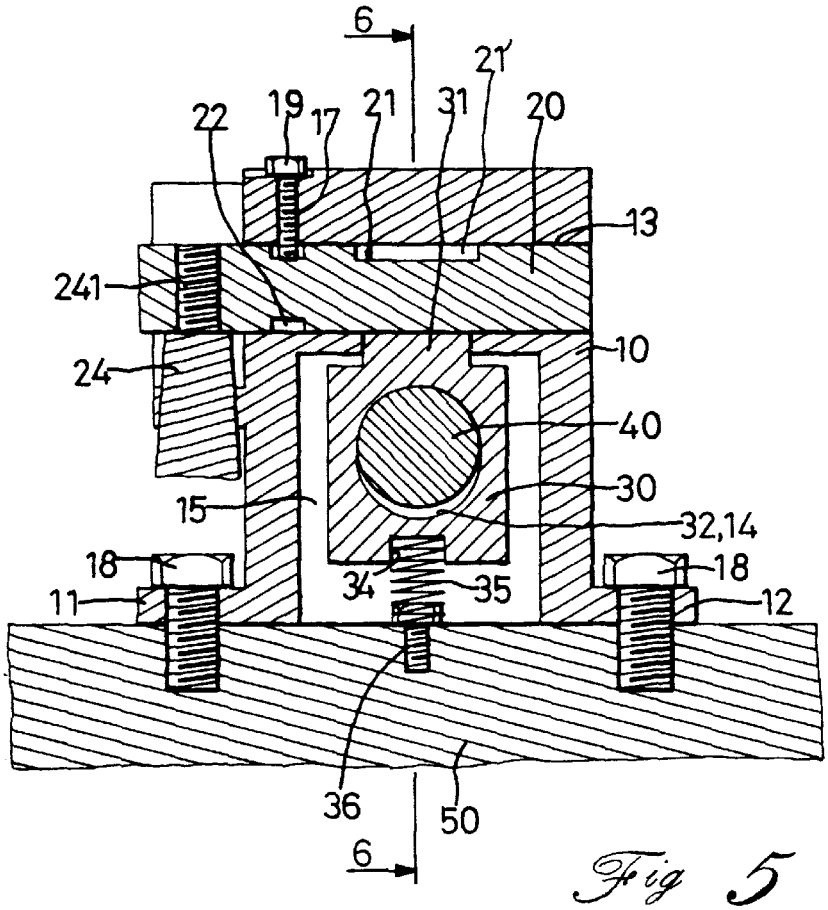
FIG. 5 is a cross-sectional view similar to FIG. 3, illustrating operation of the vise.
Figure 6:
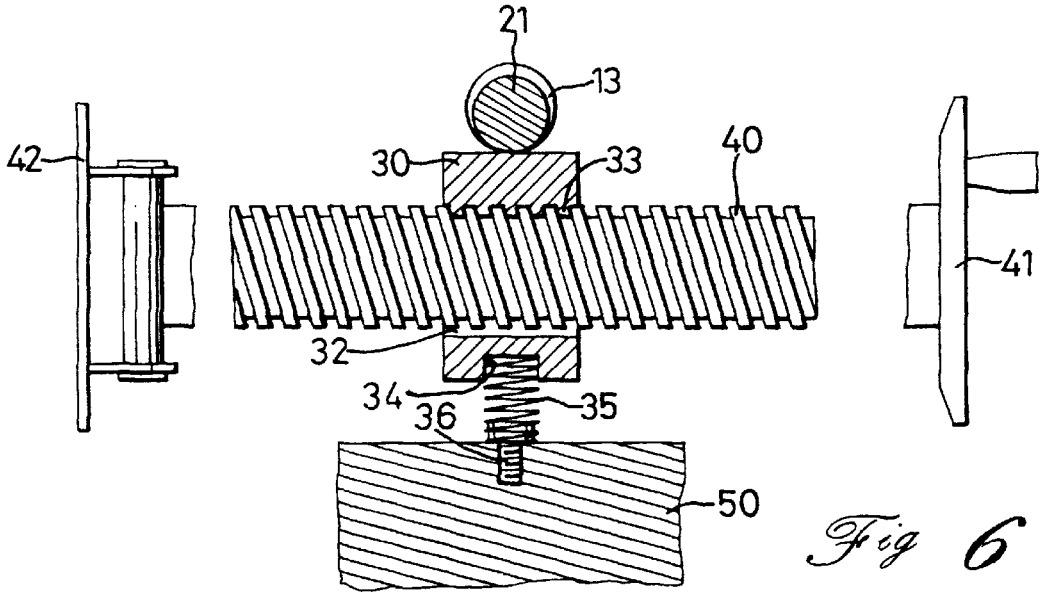
FIG. 6 is a cross sectional view taken along line 6—6 in FIG. 5.

Referring to FIGS. 5 and 6, when the handle 24 is pivoted through an angle to a second position in which the notch 21' no longer faces the compartment 15, the block 30 is moved downwardly by the eccentric section 21 of the shaft 20 such that the threading in the hole 32 engages with screw rod 40. Thus, the screw rod 40 may be rotated upon rotational movement of the operative handle 41 which allows the movable jaw 42 to approach the fixed jaw slowly so as to securely clamp a workpiece (not shown) in position.

By such an arrangement, it is appreciated that the vise of the present invention may quickly clamp the work piece without time-consuming operation of the operative handle wheel 41.

Although the invention has been explained in relation to its preferred embodiment, it is to be understood that many other possible modifications and variations can be made without departing from the spirit and scope of the invention as hereinafter claimed.

What is claimed is:

1. A vise, comprising:

a fixed body adapted to be mounted to a working table, the fixed body including a compartment defined therein, a longitudinal bore extending therethrough and partially communicating with the compartment, and a transverse bore defined in two lateral sides thereof and communicating with the compartment, a shaft pivotally mounted in the longitudinal bore, the shaft including a notch defined in a mediate portion thereof to form a reduced eccentric section, a positioning block mounted in the compartment of the fixed body and including a hole in alignment with the transverse bore, a portion of a periphery which defines the hole having a threading defined therein, an adjusting screw rod extended through the transverse bore of the fixed body and the hole of the positioning block, the adjusting screw rod including a first end and a second end, an operative handle being attached to the first end of the adjusting screw rod, and a movable jaw being fixedly attached to the second end of the adjusting screw rod, means for biasing the positioning block toward the transverse bore for releasably engaging with the reduced eccentric section of the shaft, and means for pivoting the shaft between a first position in which the shaft engages with the positioning block such that the adjusting screw rod disengages from the threading of the positioning block and a second position in which the shaft disengages from the positioning block such that the adjusting screw rod engages with the threading of the positioning block.

2. The vise according to claim 1, wherein the fixed body includes a screw hole defined in an upper side thereof and communicated with the longitudinal bore, the shaft includes an annular groove defined in a periphery thereof, and further includes a screw extended through the screw hole and into the annular groove.

3. The vise according to claim 1, wherein the shaft has an end extending beyond the fixed body, and the means for pivoting the shaft includes a handle attached to the end of the shaft.

4. The vise according to claim 1, wherein the positioning block includes a protrusion formed on an upper side thereof and extendible into the longitudinal bore.

5. The vise according to claim 1, wherein the positioning block includes a recess defined in an underside thereof, and the biasing means includes a spring having an upper end received in the recess and a lower end securely attached to the working table.

* * * * *